US009395671B1

(12) United States Patent
Yano et al.

(10) Patent No.: US 9,395,671 B1
(45) Date of Patent: Jul. 19, 2016

(54) IMAGE FORMING APPARATUS AND SHEET TRANSPORT DEVICE

(71) Applicant: FUJI XEROX CO., LTD., Toyko (JP)

(72) Inventors: Keita Yano, Kanagawa (JP); Tomoya Kosuge, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/935,104

(22) Filed: Nov. 6, 2015

(30) Foreign Application Priority Data

Jun. 5, 2015 (JP) ..... 2015-114577

(51) Int. Cl.
*G03G 15/00* (2006.01)

(52) U.S. Cl.
CPC ..... *G03G 15/65* (2013.01); *G03G 15/6573* (2013.01)

(58) Field of Classification Search
CPC ..... G03G 15/65; G03G 15/6529; G03G 15/6552; G03G 15/6573; G03G 15/6576
See application file for complete search history.

(56) References Cited

FOREIGN PATENT DOCUMENTS

JP 2004262583 A * 9/2004
JP 2014-172688 A 9/2014

OTHER PUBLICATIONS

Nagase et al. (JP 2004-262583 A), Sep. 2004, JPO Computer Translation.*

* cited by examiner

*Primary Examiner* — Erika J Villaluna
(74) *Attorney, Agent, or Firm* — Oliff PLC

(57) ABSTRACT

An image forming apparatus includes an image forming unit that forms an image on a recording material, a transport unit that transports the recording material, using a driving member which rotates and plural rotating parts which are aligned in an axial direction of the driving member and are disposed in contact with the driving member so as to rotate by receiving a driving force from the driving member, a support member that is shared by the plural rotating parts and supports the plural rotating parts from a side opposite to a side where the driving member is disposed, and a biasing unit that biases the support member toward the driving member.

7 Claims, 9 Drawing Sheets

IMAGE FORMING APPARATUS AND SHEET TRANSPORT DEVICE

CROSS-REFERENCE TO RELATED APPLICATIONS

This application is based on and claims priority under 35 USC 119 from Japanese Patent Application No. 2015-114577 filed Jun. 5, 2015.

BACKGROUND (i) Technical Field

The present invention relates to an image forming apparatus and a sheet transport device.

(ii) Related Art

Paper is transported by a transport unit including a driving member that rotates and plural rotating parts that are driven and rotated by the driving member, for example.

In such a transport unit, the rotating parts are often biased against the driving member. However, if plural biasing units respectively corresponding to the plural rotating parts are provided, the number of components is increased. Further, upon biasing the rotating parts, if a biasing unit such as a wire spring is directly pressed against the rotating parts so as bias the rotating parts, for example, noise is likely to be generated, and the rotating parts are likely to wear rapidly.

SUMMARY

According to an aspect of the present invention, there is provided an image forming apparatus including: an image forming unit that forms an image on a recording material; a transport unit that transports the recording material, using a driving member which rotates and plural rotating parts which are aligned in an axial direction of the driving member and are disposed in contact with the driving member so as to rotate by receiving a driving force from the driving member; a support member that is shared by the plural rotating parts and supports the plural rotating parts from a side opposite to a side where the driving member is disposed; and a biasing unit that biases the support member toward the driving member.

BRIEF DESCRIPTION OF THE DRAWINGS

An exemplary embodiment of the present invention will be described in detail based on the following figures, wherein.

DETAILED DESCRIPTION

An exemplary embodiment of the present invention will now be described in detail with reference to the accompanying drawings.

Figure 1:
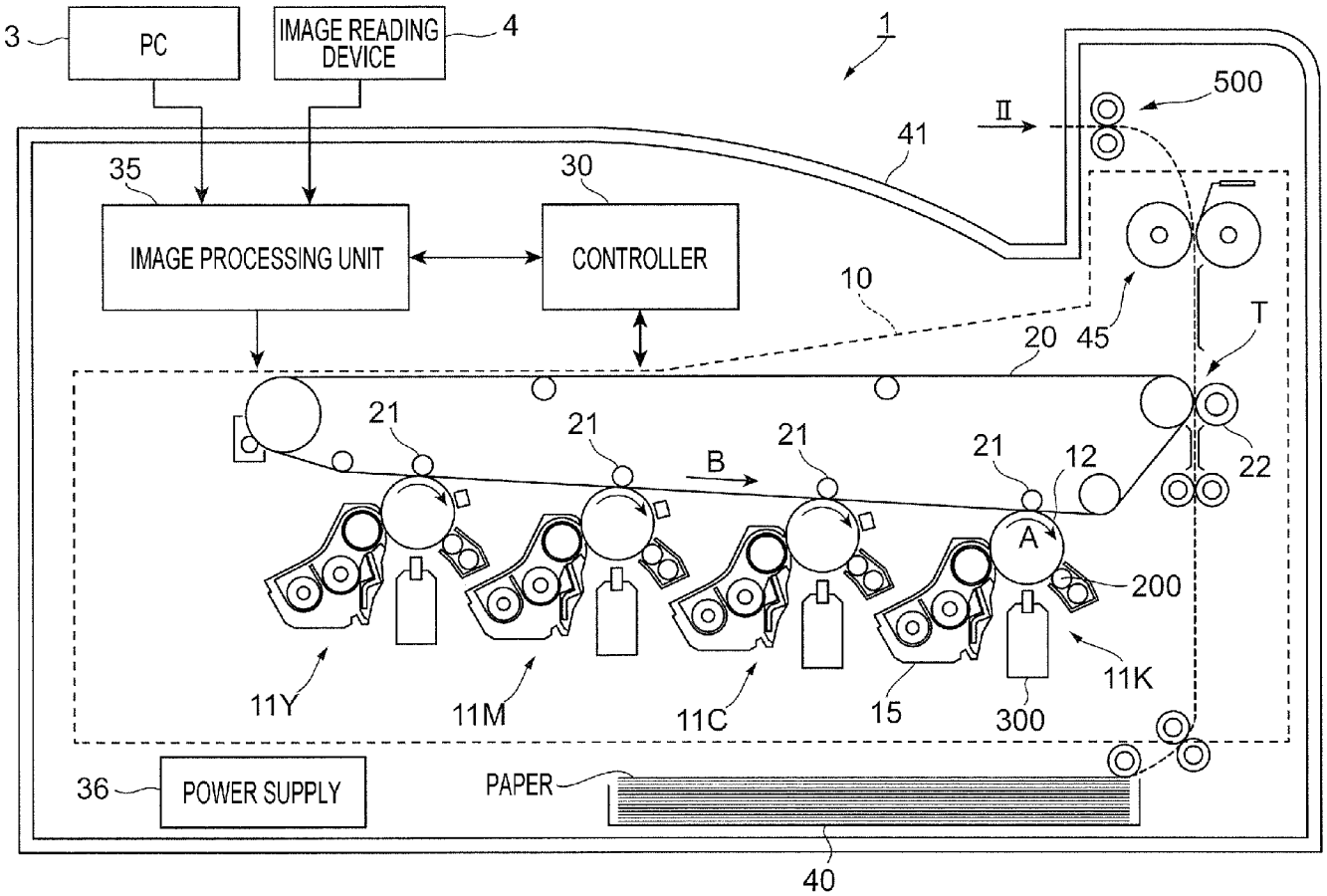
FIG. 1 illustrates the overall configuration of an image forming apparatus as viewed from the front.

FIG. 1 illustrates the overall configuration of an image forming apparatus 1 as viewed from the front according to this exemplary embodiment.

The image forming apparatus 1 is a so-called tandem type color printer. The image forming apparatus 1 includes an image forming process unit 10 as an example of an image forming unit that forms an image on paper, which is an example of a recording material. The image forming process unit 10 forms an image on paper on the basis of image data of each color.

The image forming apparatus 1 further includes a controller 30 that controls the entire operation of the image forming apparatus 1. The image forming apparatus 1 further includes an image processing unit 35.

The image processing unit 35 performs image processing on image data transmitted from a personal computer (PC) 3, an image reading device 4, and other devices. The image forming apparatus 1 further includes a power supply 36 that supplies power to each of units thereof.

The image forming process unit 10 includes four image forming units 11Y, 11M, 11C and 11K (hereinafter also collectively referred to simply as "image forming units 11")

The image forming units 11 have the same configuration except for toner contained in their developing units 15 (described below). The image forming units 11 form yellow (Y), magenta (M), cyan (C), and black (K) toner images, respectively.

Each of the image forming units 11 includes a photoconductor drum 12, a charging unit 200 that charges the photoconductor drum 12, and an LED printhead (LPH) 300 that exposes the photoconductor drum 12.

The photoconductor drum 12 is charged by the charging unit 200. Further, the photoconductor drum 12 is exposed by the LPH 300, so that an electrostatic latent image is formed on the photoconductor drum 12.

Each of the image forming units 11 further includes a cleaner (not illustrated) that cleans the surface of the photoconductor drum 12, and the developing unit 15 that develops the electrostatic latent image formed on the photoconductor drum 12.

The image forming process unit 10 further includes an intermediate transfer belt 20 onto which the toner images of the respective colors formed on the photoconductor drums 12 are transferred and superimposed, first transfer rollers 21 that sequentially transfer (first-transfer) the toner images of the respective colors formed on the photoconductor drums 12 onto the intermediate transfer belt 20, a second transfer roller 22 that collectively transfers (second-transfers) the toner images transferred on the intermediate transfer belt 20 onto paper, and a fixing unit 45 that fixes the second-transferred image onto the paper.

In the image forming apparatus 1, the image data that is input from the PC 3 and the image reading device 4 is subjected to image processing by the image processing unit 35, and is supplied to the respective image forming units 11 via an interface (not illustrated). Then, for example, in the image forming unit 11K for black (K), the photoconductor drum 12 is charged by the charging unit 200 while rotating in the direction of an arrow A, and is exposed by the LPH 300 that emits light on the basis of the image data transmitted from the image processing unit 35.

Thus, an electrostatic latent image for the black (K) image is formed on the photoconductor drum 12.

The electrostatic latent image formed on the photoconductor drum 12 is developed by the developing unit 15, so that a toner image of black (K) is formed on the photoconductor drum 12.

Likewise, toner images of yellow (Y), magenta (M), and cyan (C) are formed in the image forming units 11Y, 11M, and 11C, respectively.

The toner images of the respective colors formed in the image forming units 11 are sequentially electrostatically attracted by the first transfer rollers 21 to the intermediate transfer belt 20 rotating in the direction of an arrow B, so that superimposed toner images of the respective colors are formed thereon.

The toner images on the intermediate transfer belt 20 are transported by the rotation of the intermediate transfer belt 20 to an area (second transfer section T) where the second transfer roller 22 is disposed.

When the toner images are transported to the second transfer section T, paper is fed from a paper holder 40 to the second transfer section T in synchronization with the timing when the toner images are transported to the second transfer section T.

Then, the toner images on the intermediate transfer belt 20 are collectively electrostatically transferred onto the transported paper by an effect of a transfer electric field produced by the second transfer roller 22 in the second transfer section T.

Subsequently, the paper with the toner images electrostatically transferred thereon is separated from the intermediate transfer belt 20, and is transported to the fixing unit 45. The toner images on the paper transported to the fixing unit 45 are subjected to a fixing process by the fixing unit 45 using heat and pressure so as to be fixed to the paper.

After completion of the fixing process, the paper is transported to a paper stacker 41 by an ejection roller 500 that serves as a transport unit.

A section of the image forming apparatus 1 where the ejection roller 500 is disposed has a function of transporting paper. Therefore, this section may be regarded as a sheet transport device.

Figure 2A:
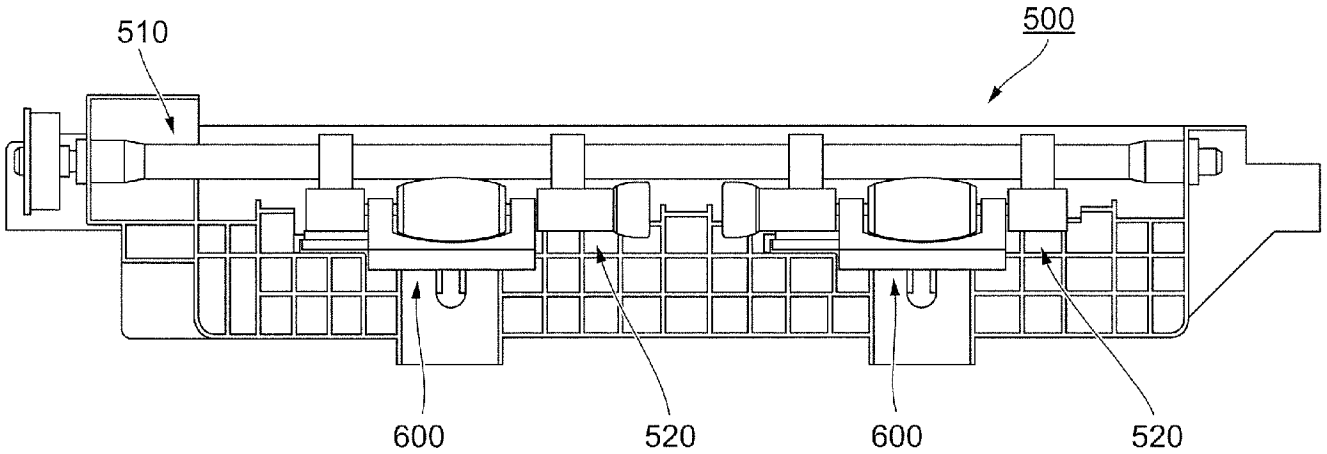
FIGS. 2A and 2B illustrate an ejection roller.
Figure 2B:
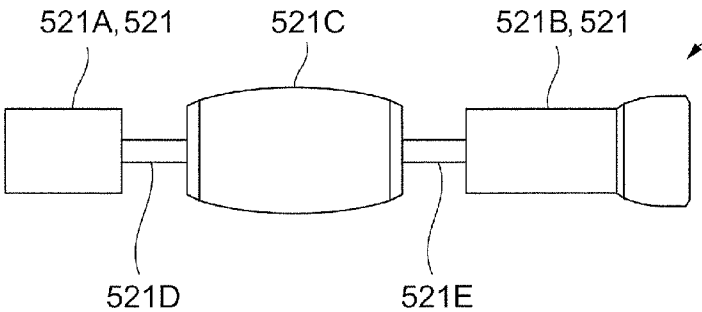

FIGS. 2A and 2B illustrate the ejection roller 500.

Note that FIG. 2A illustrates the ejection roller 500 as viewed from the direction of an arrow II of FIG. 1. FIG. 2B illustrates a rotating roller 520.

As illustrated in FIG. 2A, the ejection roller 500 of this exemplary embodiment includes a driving roller 510 and two rotating rollers 520.

The driving roller 510 as an example of a driving member is supported at opposite axial ends thereof by the body side of the image forming apparatus 1. Further, the driving roller 510 is arranged so as to extend in the direction orthogonal to a sheet transport direction, and rotates by receiving a rotational driving force from a motor (not illustrated).

The two rotating rollers 520 are aligned in the axial direction of the driving roller 510. Further, each of the rotating rollers 520 is disposed in contact with the driving roller 510, and rotates by receiving a driving force from the driving roller 510.

Paper having been transported to the ejection roller 500 via the fixing unit 45 (see FIG. 1) is held between the driving roller 510 and the two rotating rollers 520, and is sent to the paper stacker 41 (see FIG. 1) by receiving a transporting force from the driving roller 510.

As illustrated in FIG. 2B, each of the rotating rollers 520 includes two rotating parts 521. Hereinafter, one of the rotating parts 521 that is disposed at the left side in FIG. 2B is referred to as a left rotating part 521A, and the other one of the rotating parts 521 that is disposed at the right side in FIG. 2B is referred to as a right rotating part 521B.

Further, in each of the rotating rollers 520, a shape imparting roller 521C that imparts a wave shape to paper is provided between the left rotating part 521A and the right rotating part 521B.

Further, as illustrated in FIG. 2B, a left connecting part 521D and a right connecting part 521E are provided. The left connecting part 521D connects the left rotating part 521A and the shape imparting roller 521C to each other. The right connecting part 521E connects the right rotating part 521B and the shape imparting roller 521C to each other.

Each of the rotating rollers 520 is formed by injection molding (of a resin material). The left rotating part 521A, the right rotating part 521B, the left connecting part 521D, the right connecting part 521E, and the shape imparting roller 521C are integrally formed.

The left rotating part 521A and the right rotating part 521B are each formed in a cylindrical shape, and are aligned in the axial direction of the driving roller 510.

Further, each of the left rotating part 521A and the right rotating part 521B is disposed in contact with the driving roller 510, and rotates by receiving a rotational driving force from the driving roller 510.

The diameter of the shape imparting roller 521C is greater at the axial center thereof than at the opposite axial ends thereof. When paper passes over the shape imparting roller 521C, the paper is deformed into a wave shape in cross section. Accordingly, the bending rigidity of the paper is increased, which prevents the leading edge of the paper from hanging down when the paper is ejected into the paper stacker 41 (see FIG. 1).

Further, in this exemplary embodiment, as illustrated in FIG. 2A, support members 600 are provided that support the rotating rollers 520.

The support members 600 are disposed at the opposite side of the rotating rollers 520 to the side where the driving roller 510 is disposed. The two support members 600 are provided so as to respectively correspond to the two rotating rollers 520.

Further, in this exemplary embodiment, although each rotating roller 520 includes two rotating parts 521 (the left rotating part 521A and the right rotating part 521B), these two rotating parts 521 share one common support member 600, and the two rotating parts 521 are supported by the common support member 600 (one support member 600). In this exemplary embodiment, the support member 600 supports the two rotating parts 521 from the side opposite to the side where the driving roller 510 serving as a driving member is disposed.

Although it is possible to provide one support member 600 for each rotating part 521 such that one support member 600 corresponds to one rotating part 521, this increases the number of components and increases the production costs. On the other hand, in this exemplary embodiment, one support member 600 is provided for every two rotating parts 521, and therefore the number of components is reduced.

Figure 3:
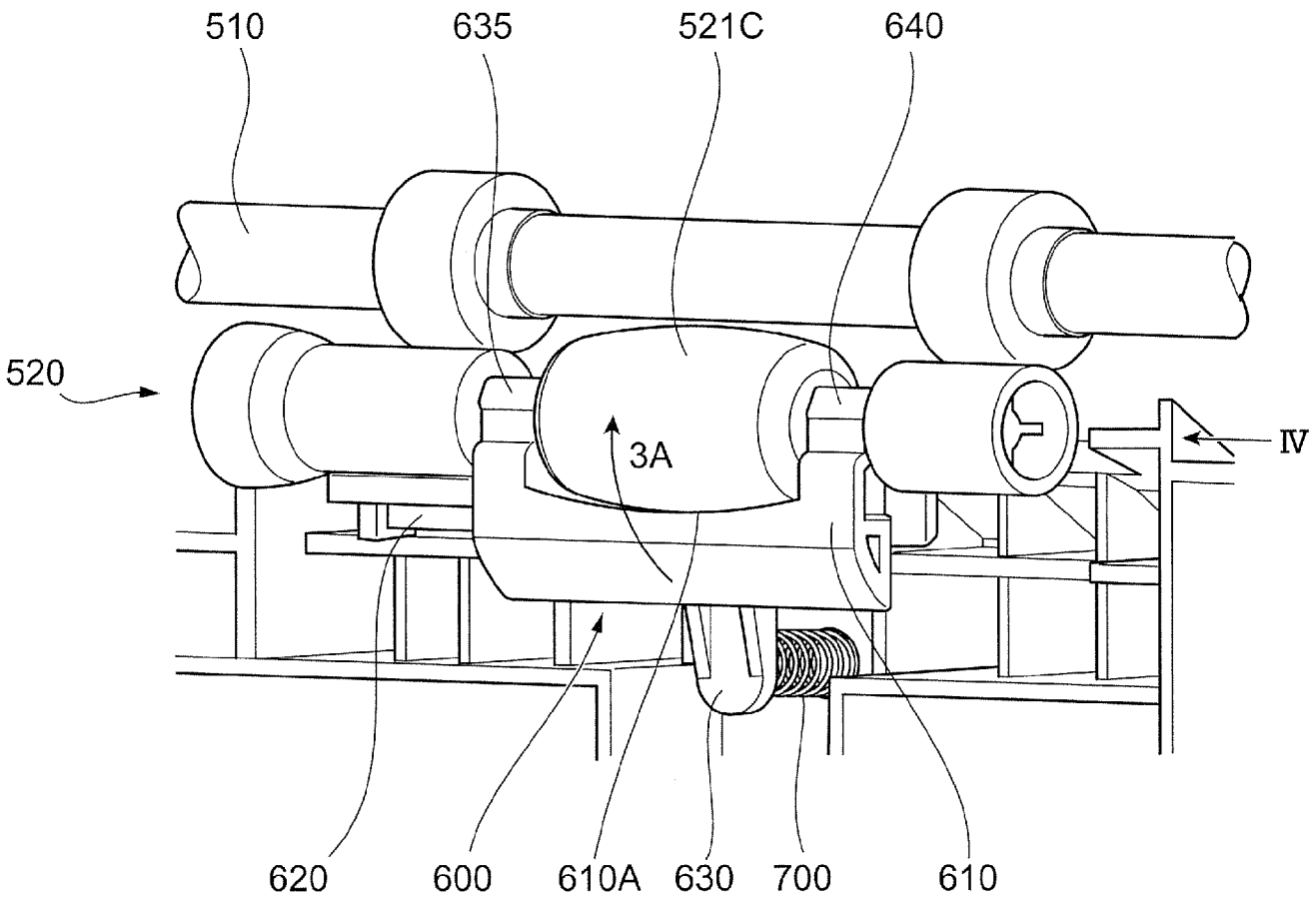
FIG. 3 is a perspective view illustrating a support member and a rotating roller.

FIG. 3 is a perspective view illustrating one of the two support members 600 and one of the two rotating rollers 520. More specifically, FIG. 3 is a perspective view illustrating the support member 600 and the rotating roller 520 disposed at the right side in FIG. 2A. Note that the support member 600 and the rotating roller 520 at the left side have configurations similar to those of the support member 600 and the rotating roller 520 at the right side.

The support member 600 includes a base 610 having a recess 610A that accommodates the shape imparting roller 521C. The base 610 is arranged so as to extend in the axial direction of the driving roller 510. Further, the support member 600 includes an arm 620 extending leftward in FIG. 3 from the left side surface of the base 610, and a protrusion 630 protruding downward from the base 610.

Further, the support member 600 includes a first support part 635 disposed at the left side of the recess 610A in FIG. 3 and supporting the left connecting part 521D (see FIG. 2B) of the rotating roller 520 from below. Further, the support member 600 includes a second support part 640 disposed at the right side of the recess 610A in FIG. 3 and supporting the right connecting part 521E (see FIG. 2B) of the rotating roller 520 from below.

Further, in this exemplary embodiment, a coil spring 700 is provided. The coil spring 700 serves as a biasing unit that biases the support member 600 toward the driving roller 510.

In this exemplary embodiment, the protrusion 630 of the support member 600 serves as a pressed part that is pressed by the coil spring 700, and the protrusion 630 is pressed by the coil spring 700. Thus, the support member 600 rotates in the direction indicated by an arrow 3A in FIG. 3, so that the support member 600 is biased toward the driving roller 510 and the rotating roller 520 by the rotation. Note that the mechanism for rotating the support member 600 will be described below.

Figure 4:
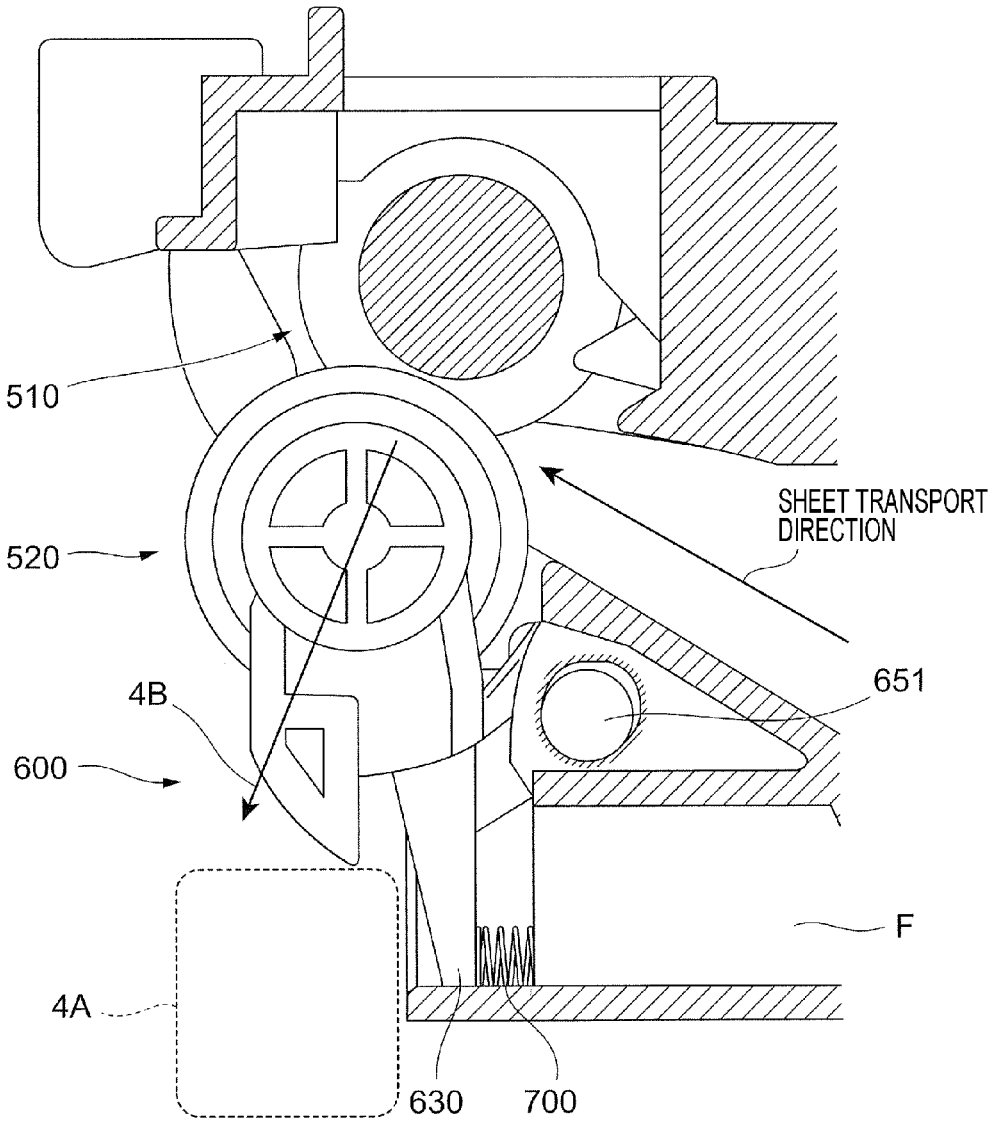
FIG. 4 illustrates the rotating roller, the support member, the driving roller, and other components as viewed from the direction of an arrow IV of FIG. 3.

FIG. 4 illustrates the rotating roller 520, the support member 600, the driving roller 510, and other components as viewed from the direction of an arrow IV of FIG. 3.

Although not illustrated in FIGS. 2A, 2B, and 3, the support member 600 includes a first column-shaped projection 651 serving as a rotary shaft, and is rotatable about the first column-shaped projection 651.

The first column-shaped projection 651 is formed in a column shape, and is arranged so as to extend in the axial direction of the rotating roller 520 and the axial direction of the driving roller 510.

Further, in this exemplary embodiment, an apparatus frame F is disposed at the body side of the image forming apparatus 1. In this exemplary embodiment, the coil spring 700 is disposed between the apparatus frame F and the protrusion 630 of the support member 600. Accordingly, in this exemplary embodiment, a force that rotates the support member 600 about the first column-shaped projection 651 is applied to the support member 600. Thus, the support member 600 rotates in the clockwise direction in FIG. 4, so that the support member 600 is biased toward the driving roller 510 and the rotating roller 520.

The configuration of this exemplary embodiment is not a configuration in which the support member 600 is biased by being pressed from below. Therefore, the space under the support member 600 (the space indicated by the reference numeral 4A) is free, so that the space under the support member 600 may be used.

Further, in this exemplary embodiment, it is possible to bias the support member 600 toward the driving roller 510 without providing a biasing unit at the opposite side of the support member 600 to the side where the driving roller 510 is disposed.

When the support member 600 is biased toward the driving roller 510, the rotating roller 520 is pressed against the driving roller 510. Then, in this exemplary embodiment, in response to this pressing motion, a reaction force indicated by an arrow 4B in FIG. 4 is applied to the rotating roller 520 and the support member 600.

When the reaction force is applied to the support member 600, the first column-shaped projection 651 of the support member 600 is pressed against the apparatus frame F.

Figure 5:
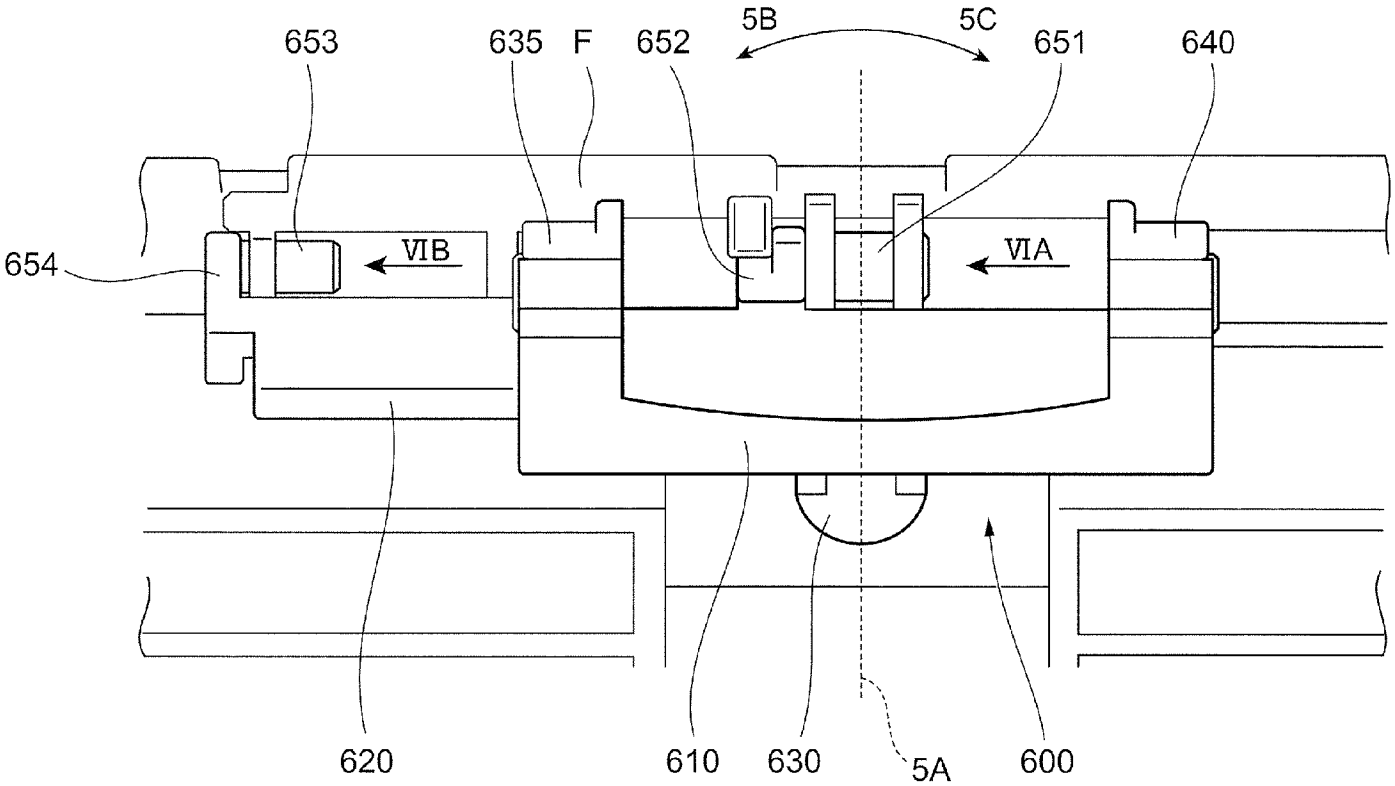
FIG. 5 is a front view illustrating the support member with the rotating roller removed.

FIG. 5 is a front view illustrating the support member 600 with the rotating roller 520 removed.

In this exemplary embodiment, the first column-shaped projection 651 is disposed at the apparatus frame F side of the base 610. The support member 600 is provided with a protrusion 652 protruding from the base 610 toward the apparatus frame F side, and the first column-shaped projection 651 protrudes from a side surface of the protrusion 652. The first column-shaped projection 651 is disposed at a position facing the longitudinal center of the base 610.

Further, the support member 600 is provided with a second column-shaped projection 653. This second column-shaped projection 653 is disposed at the distal end of the arm 620.

More specifically, a protrusion 654 protruding toward the apparatus frame F side is also provided at the distal endo of the arm 620, and the second column-shaped projection 653 protrudes from a side surface of the protrusion 654.

Similar to the first column-shaped projection 651, the second column-shaped projection 653 is arranged so as to extend in the axial direction of the rotating roller 520 and the axial direction of the driving roller 510.

Both the projecting direction of the first column-shaped projection 651 and the projecting direction of the second column-shaped projection 653 are the right direction in FIG. 5. That is, the projecting direction of the first column-shaped projection 651 and the projecting direction of the second column-shaped projection 653 are the same.

Further, in this exemplary embodiment, the support member 600 oscillates around the point where the first column-shaped projection 651 is disposed as the oscillation center. More specifically, the support member 600 is oscillatable such that each of the first support part 635 and the second support part 640 moves toward and away from the driving roller 510 (see FIG. 2A).

Further, in this exemplary embodiment, the protrusion 630 serves as a pressed part, and this pressed part is pressed by the coil spring 700.

Further, in this exemplary embodiment, in the lateral direction (the axial direction of the driving roller 510) in FIG. 5, the position of the first column-shaped projection 651 and the position of the protrusion 630 are aligned, and the position of the oscillation center of the support member 600 and the position of the pressed part of the support member 600 that is pressed by the coil spring 700 are aligned.

Further, in this exemplary embodiment, the oscillation center and the pressed position are located on a straight line (a straight line denoted by the reference numeral 5A) extending in the direction orthogonal to the axial direction of the driving roller 510 (the lateral direction in FIG. 5).

Thus, in this exemplary embodiment, oscillation of the support member 600 occurs more easily than in the case where the position of the oscillation center and the position of the pressed part are not aligned.

Further, both oscillation of the support member 600, that is, rotation of the support member 600, in the direction denoted by the reference numeral 5B in FIG. 5 and oscillation of the support member 600, that is, rotation of the support member 600, in the direction denoted by the reference numeral 5C in FIG. 5 occur easily. Accordingly, in this exemplary embodiment, it is easy to use the common support member 600 as a common component (as will be described).

Figure 6A:
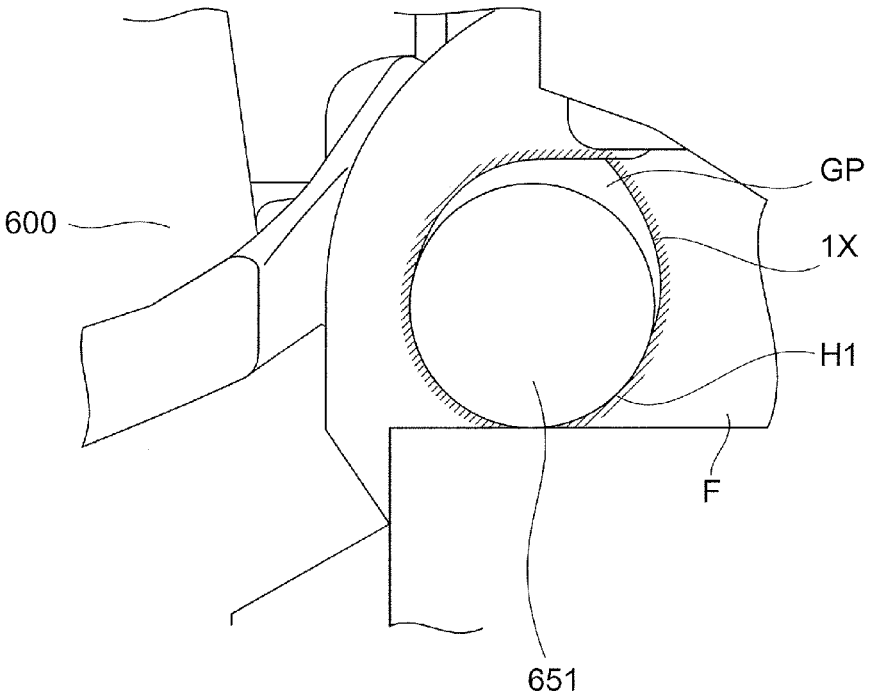
FIGS. 6A and 6B illustrate the configuration around a first column-shaped projection and the configuration around a second column-shaped projection, respectively.
Figure 6B:
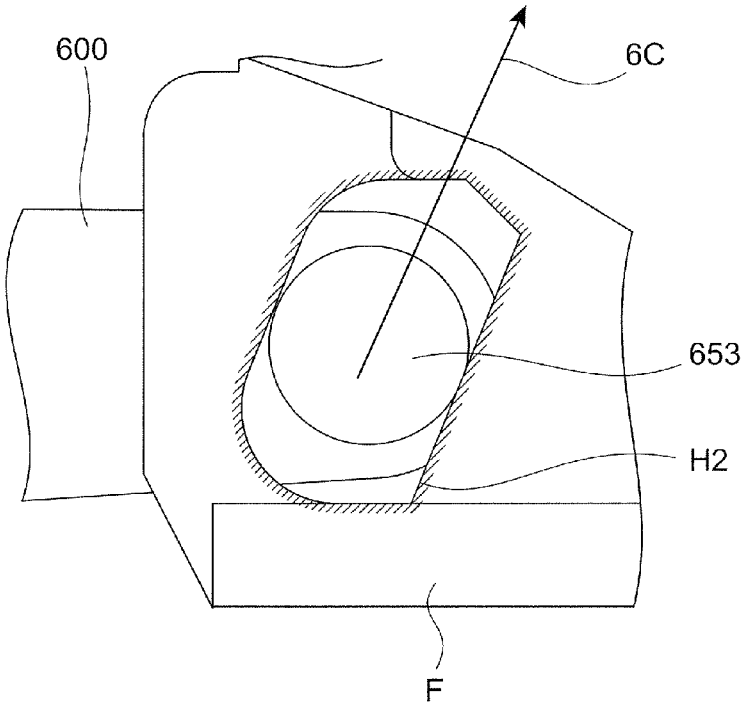

FIGS. 6A and 6B illustrate the configuration around the first column-shaped projection 651 and the configuration around the second column-shaped projection 653, respectively. Specifically, FIG. 6A illustrates the first column-shaped projection 651 and other components as viewed from the direction of an arrow VIA of FIG. 5, and FIG. 6B illustrates the second column-shaped projection 653 and other components as viewed from the direction of an arrow VIB of FIG. 5.

As illustrated in FIG. 6A, a first through hole H1 in which the first column-shaped projection 651 is inserted is formed at the apparatus frame F side. The first through hole H1 is formed in a substantially circular shape, and has a diameter greater than the outer diameter of the first column-shaped projection 651.

In this exemplary embodiment, as described above, the reaction force from the driving roller 510 is applied to the support member 600, so that the support member 600 is biased downward in FIG. 6A. Accordingly, the first column-shaped projection 651 is also biased downward, so that the first column-shaped projection 651 is pressed against the apparatus frame F.

More specifically, the first column-shaped projection 651 is pressed against a portion of a peripheral edge 1X of the first through hole H1 located at the lower side of the first column-shaped projection 651. When the first column-shaped projection 651 is pressed against the portion located at the lower side of the first column-shaped projection 651, a gap GP is formed at the upper side of the first column-shaped projection 651. More specifically, the gap GP is formed between the first column-shaped projection 651 and a portion of the peripheral edge 1X of the first through hole H1 located at the upper side of the first column-shaped projection 651.

Further, as illustrated in FIG. 6B, a second through hole H2 in which the second column-shaped projection 653 is inserted is formed in the apparatus frame F.

A part of the apparatus frame F where the second through hole H2 is disposed serves as a come-off preventing part, and prevents the support member 600 from coming off the body of the image forming apparatus 1 by restricting the movement of the second column-shaped projection 653 in the direction away from the apparatus frame F.

The second through hole H2 is formed as an elongated hole. This elongated hole is formed so as to extend in the direction in which the support member 600 is biased (the direction indicated by an arrow 6C in FIG. 6, the direction of application of the reaction force that is applied from the driving roller 510 to the support member 600).

In this exemplary embodiment, since the second through hole H2 is formed as an elongated hole, it is possible to displace the second column-shaped projection 653, which allows the support member 600 to oscillate (as will be described below in detail).

Figure 7:
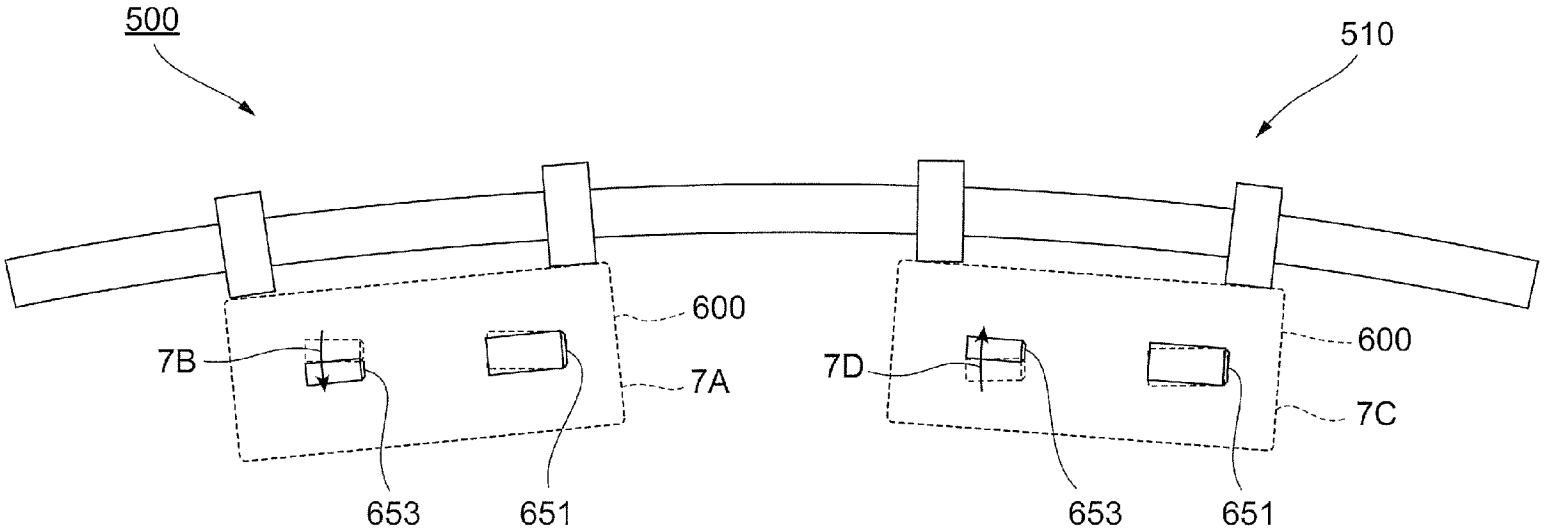
FIG. 7 illustrates the oscillation of the support members.

FIG. 7 illustrates oscillation of the support members 600. In FIG. 7, as for each support member 600, only the first column-shaped projection 651 and the second column-shaped projection 653 are illustrated, while the other elements such as the base 610 are omitted. Further, in FIG. 7, the rotating rollers 520 are also omitted.

In this exemplary embodiment, each support member 600 is biased toward the driving roller 510, so that the rotating parts 521 (see FIG. 2B) (the left rotating part 521A and the right rotating part 521B) of the rotating roller 520 is pressed against the driving roller 510.

Thus, in this exemplary embodiment, as illustrated in FIG. 7, the driving roller 510 is curved so as to project upward in FIG. 7.

Then, in this exemplary embodiment, the support member 600 is displaced such that the rotating parts 521 move and follow the curvature of the driving roller 510. More specifically, in this exemplary embodiment, the two rotating parts 521 are provided for each of the two support members 600, and each of the support members 600 is displaced such that the two rotating parts 521 move and follow the driving roller 510.

That is, in this exemplary embodiment, the support member 600 is oscillatable about the first column-shaped projection 651, and this oscillation of the support member 600 allows the rotating parts 521 to follow the driving roller 510.

The movement of the support member 600 at the left side denoted by the reference numeral 7A in FIG. 7 will now be described.

In this exemplary embodiment, the driving roller 510 is curved so as to project upward in FIG. 7, so that the first column-shaped projection 651 of the support member 600 moves farther toward the driving roller 510 than the second column-shaped projection 653 of the support member 600.

Accordingly, in this exemplary embodiment, the support member 600 rotates about the first column-shaped projection 651 in the counterclockwise direction in FIG. 7.

This prevents a gap from being formed between the left rotating part 521A and the right rotating part 521B of the rotating roller 520 (see FIG. 2B) and the curved driving roller 510, and ensures the contact of the left rotating part 521A and the right rotating part 521B with the driving roller 510.

Note that when the support member 600 rotates in the counterclockwise direction, the second column-shaped projection 653 moves downward as indicated by an arrow 7B in FIG. 7. As mentioned above, the second through hole H2 in which the second column-shaped projection 653 is inserted is formed as an elongated hole, which allows this movement of the second column-shaped projection 653.

Next, the movement of the support member 600 at the right side denoted by the reference numeral 7C in FIG. 7 will be described.

In the support member 600 at the right side, the second column-shaped projection 653 moves toward the driving roller 510 a greater distance than the first column-shaped projection 651. Accordingly, in this exemplary embodiment, the support member 600 rotates about the first column-shaped projection 651 in the clockwise direction in FIG. 7.

In this case as well, this prevents a gap from being formed between the left rotating part 521A and the right rotating part 521B of the rotating roller 520 and the curved driving roller 510, and ensures the contact of the left rotating part 521A and the right rotating part 521B with the driving roller 510.

Note that when the support member 600 rotates in the clockwise direction, the second column-shaped projection 653 moves upward as indicated by an arrow 7D in FIG. 7. As mentioned above, the second through hole H2 in which the second column-shaped projection 653 is inserted is formed as an elongated hole, which allows this movement of the second column-shaped projection 653.

In this exemplary embodiment, as described above, the position of the oscillation center of the support member 600 and the position of the pressed part are aligned in the axial direction of the driving roller 510.

Further, as illustrated in FIG. 5, the oscillation center (the first column-shaped projection 651) and the pressed part (the protrusion 630) are disposed at the longitudinal center of the base 610.

Accordingly, in this exemplary embodiment, both clockwise rotation and counterclockwise rotation of the support member 600 occur easily.

If the position of the oscillation center and the position of the pressed part are not aligned, one of clockwise rotation and counterclockwise rotation occurs easily, and the other does not occur easily.

Further, in this exemplary embodiment, the support member 600 is used as a common component. That is, the two support members 600 have the same shape as illustrated in FIG. 2A.

Accordingly, compared to the case where one of the support members 600 has a shape different from the shape of the other support member 600, the costs for production of the image forming apparatus 1 are reduced.

In this exemplary embodiment, as illustrated in FIG. 7, the direction of the curvature of the driving roller 510 is different at the position facing one of the support members 600 and at the position facing the other one of the support members 600. However, as described above, in this exemplary embodiment, both clockwise rotation and counterclockwise rotation of the support member 600 occur easily. Therefore, even though the direction of the curvature of the driving roller 510 varies, a common support member 600 is applicable.

Note that, as illustrated in FIG. 5 and so on, in this exemplary embodiment, the second column-shaped projection 653 is disposed at the left side in FIG. 5 and so on. However, the second column-shaped projection 653 may be disposed at the right side in FIG. 5 and so on.

Further, although not described above, the first column-shaped projection 651 also has a function of preventing the support member 600 from coming off the apparatus frame F. When the support member 600 is to come off the apparatus frame F, the first column-shaped projection 651 is caught on the apparatus frame F, and the support member 600 is prevented from coming off the apparatus body side of the image forming apparatus 1.

Figure 8:
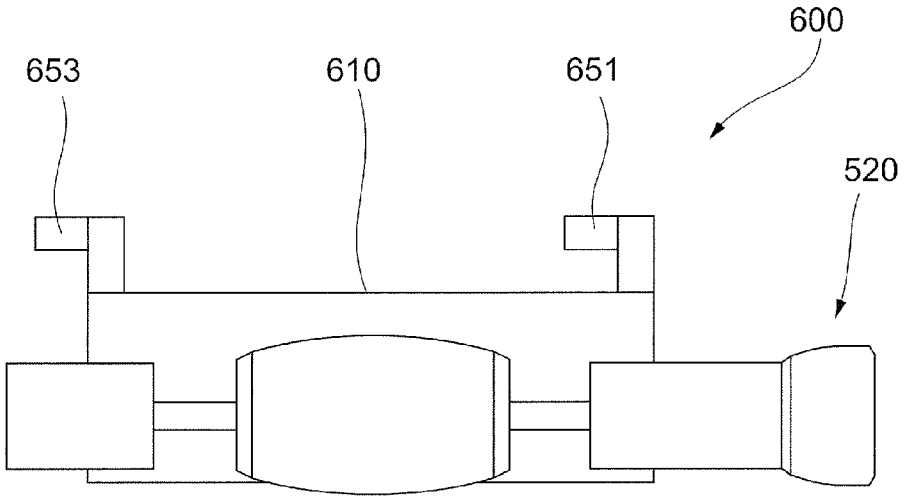
FIG. 8 illustrates a modification of the support member.

FIG. 8 illustrates a modification of the support member 600. Note that FIG. 8 illustrates the support member 600 and the rotating roller 520 as viewed from the above.

In the exemplary embodiment described above, an exemplary configuration has been described in which the first column-shaped projection 651 is disposed at a position facing the longitudinal center of the base 610. However, the first column-shaped projection 651 may be disposed at a position facing a longitudinal end of the base 610 as illustrated in FIG. 8.

Further, an example has been described above in which, as illustrated in FIG. 5, the first column-shaped projection 651 and the second column-shaped projection 653 project rightward in FIG. 5. However, as illustrated in FIG. 8, the first column-shaped projection 651 and the second column-shaped projection 653 may project leftward in FIG. 8.

Figure 9:
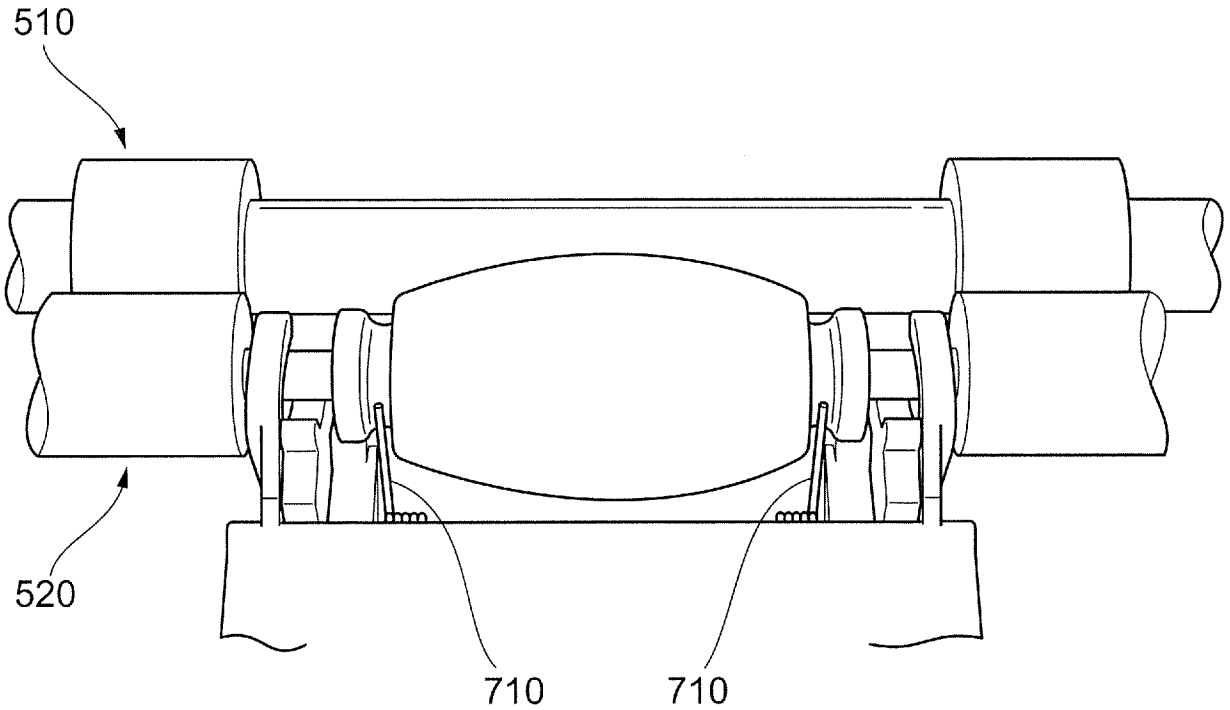
FIG. 9 illustrates a comparative example related to supporting of the rotating roller.

FIG. 9 illustrates a comparative example related to supporting of the rotating roller 520.

In this comparative example, a wire spring 710 is pressed against the rotating roller 520 so as to bias the rotating roller 520 toward the driving roller 510. In this comparative example, the wire spring 710 made of metal is pressed against the rotating roller 520. Further, the contact area between the rotating roller 520 and the wire spring 710 is small. Therefore, noise is likely to be generated, and the rotating roller 520 is likely to wear.

On the other hand, in this exemplary embodiment, the coil spring 700 made of metal is not in direct contact with the rotating roller 520. Instead, the support member 600 made of resin is disposed between the coil spring 700 and the rotating roller 520 such that the support member 600 in a stationary state and the coil spring 700 are in contact with each other. In other words, in this exemplary embodiment, the coil spring 700 is in contact with a member (the support member 600) that does not perform a rotational movement.

Further, in this exemplary embodiment, compared to the above-described comparative example in which the wire spring 710 is used, the contact area between the rotating roller 520 and a contact member (the support member 600) that is in contact therewith is greater.

Accordingly, in this exemplary embodiment, compared to the above-described comparative example, noise is less likely to be generated, and the rotating roller 520 is less likely to wear.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming unit that forms an image on a recording material;

a transport unit that transports the recording material, using a driving member which rotates and a plurality of rotating parts which are aligned in an axial direction of the driving member and are disposed in contact with the driving member so as to rotate by receiving a driving force from the driving member;

a support member that is shared by the plurality of rotating parts and supports the plurality of rotating parts from a side opposite to a side where the driving member is disposed; and a biasing unit that biases the support member toward the driving member, the biasing unit being disposed between individual ones of the rotating parts in the axial direction of the driving member.

2. The image forming apparatus according to claim 1, wherein:

the support member includes a rotary shaft extending in the axial direction of the driving member, and is rotatable about the rotary shaft; and the biasing unit biases the support member toward the driving member, by applying to the support member a force that rotates the support member about the rotary shaft.

3. The image forming apparatus according to claim 1, wherein:

when the support member is biased toward the driving member such that the rotating parts are pressed against the driving member, the driving member is curved; and the support member is displaceable such that each of the plurality of rotating parts moves and follows the curved driving member.

4. The image forming apparatus according to claim 1, wherein:

a come-off preventing part in which a part of the support member is inserted is provided at a body side of the image forming apparatus, the come-off preventing part preventing the support member from coming off the body side; and a portion of the come-off preventing part in which the part of the support member is inserted is formed as an elongated hole extending in a direction in which the support member is biased.

5. A sheet transport device comprising:

a transport unit that transports a recording material, using a driving member which rotates and a plurality of rotating parts which are aligned in an axial direction of the driving member and are disposed in contact with the driving member so as to rotate by receiving a driving force from the driving member;

a support member that is shared by the plurality of rotating parts and supports the plurality of rotating parts from a side opposite to a side where the driving member is disposed; and a biasing unit that biases the support member toward the driving member, the biasing unit being disposed between individual ones of the rotating parts in the axial direction of the driving member.

6. The sheet transport device according to claim 5, wherein:

when the support member is biased toward the driving member such that the rotating parts are pressed against the driving member, the driving member is curved; and the support member is displaceable such that each of the plurality of rotating parts moves and follows the curved driving member.

7. The image forming apparatus according to claim 5, wherein:

the support member is oscillatable about a predetermined oscillation center, and is biased toward the driving member when a predetermined pressed part thereof is pressed by the biasing unit; and a position of the oscillation center in the axial direction of the driving member and a position of the pressed part in the axial direction are aligned in the axial direction.

* * * * *